United States Patent [19]

Murphy, Jr.

[11] 4,019,325

[45] Apr. 26, 1977

[54] ENERGY CONVERTER

[76] Inventor: Paschal H. Murphy, Jr., Rte. 2, Box 104B, Zephyrhills, Fla. 33599

[22] Filed: Sept. 5, 1975

[21] Appl. No.: 610,790

[52] U.S. Cl. ..... 60/643; 60/530; 60/669; 60/721

[51] Int. Cl.[2] ..... F01K 27/00

[58] Field of Search ..... 60/643, 669, 721, 675, 60/530, 531; 185/4, 27

[56] References Cited

UNITED STATES PATENTS 2,384,168 9/1945 Hillery ..... 60/675 X 2,398,471 4/1946 Short et al. ..... 60/675 X

*Primary Examiner*—Allen M. Ostrager

[57] ABSTRACT

An energy converter of the type primarily intended for transforming thermal energy into mechanical energy. The converter accomplishes this transformation by using heat to expand a fluid, resulting in movement of a mass which is in turn attached to a flywheel surrounding an axle. Moving the mass imbalances the flywheel causing its rotation. A usable work force is generated by this rotation.

24 Claims, 6 Drawing Figures

ENERGY CONVERTER

BACKGROUND OF THE INVENTION

1. Field of the Invention

This invention relates to a device for converting relatively small units of thermal energy into a working mechanical force, said transformation being accomplished in an extremely economical manner.

2. Description of the Prior Art

Various forms of thermal motors for converting heat energy into mechanical motion are known in the prior art. In recent years, no doubt due to the recurring energy crises facing the United States, the interest in such devices has been significantly rekindled. Such prior art devices almost inevitably comprise a structure whereby heat is used to create an imbalance resulting in rotary motion of a drive shaft-type member.

For example, many prior art devices teach the use of volatile liquid as the mass utilized to create an imbalance. Heat is applied to the liquid causing it to volatize and move to a position which is eccentric with respect to the drive shaft. Other prior art devices teach the use of metallic elements wherein the metal has an unusually high coefficient of linear expansion. In these devices heating the metallic element causes it to expand, resulting in the displacement of a weight attached to the metallic element. Still other prior art devices teach the use of a gas or liquid as an exhaust fluid to assist in maintaining the angular velocity of a rotating drive shaft.

However, such prior art devices have generally proved to be unsuitable for the performance of any meaningful work. The structures themselves are often times so large and complicated that they are much more expensive than the benefits derived therefrom. In systems utilizing liquids it has been necessary to provide a constant replenishment source for the liquid so that the device will continue to operate. Devices utilizing expanding metallic elements are quite obviously extremely subject to the deleterious effects of their environment. That is to say, when exposed to the atmosphere for prolonged periods of time the metallic elements corrode, necessarily resulting in loss of efficiency. However, perhaps the greatest problem encountered with prior art devices lies not in heating the conversion material, but rather in cooling it so that the cycle may be repeated.

Accordingly, it is obvious that there is a great need in the art for a reliable, economical means of transforming thermal energy into a useful work force. Such a device should be of relatively simple construction, and should define a closed system so that all that is required for its operation is a continuous source of thermal energy. And, of course, the device must include means for rapidly cooling the conversion material so that the transformation cycle may be repeated to provide a constant mechanical force. Finally, the energy converter must be compatible with a wide variety of thermal energy sources, such a solar energy, industrial waste heat, lasers, electricity, and flames.

SUMMARY OF THE INVENTION

The present invention relates to a device for transforming thermal energy into a working mechanical force. The construction which will be set forth in greater detail hereinafter provides for the use of an expansible fluid to reposition a mass with respect to the axis of rotation of a drive shaft. Repositioning the mass causes it to fall due to the force of gravity. It is actually the force of the falling mass which is imparted to the drive shaft. Means in the form of valves may be provided for the purpose of enhancing the rotation of the drive shaft by selectively exhausting the expanded fluid. A flywheel means is provided for the purpose of maintaining a relatively constant rate of rotation of the converter drive shaft.

The energy converter of the present invention basically comprises support means having a drive shaft in the form of axle means rotably disposed thereon. A flywheel including a movable eccentric weight disposed thereon is utilized to accomplish the energy transformation. An expansible gas is heated to move the eccentric weight, causing it to fall under the earth's gravitation field and imparting this motion to the rotational movement of the flywheel and to the axle supporting the flywheel. The resultant rotating axle power can be utilized directly or by conventional clutching arrangements.

The flywheel is disposed in conventional, substantially concentric relation to the axis of rotation of the axle. At least one piston means extends across the flywheel in substantially transverse relation to the axle's axis of rotation so that the piston's mid-point is substantially coincident with the axis of rotation. The movable eccentric weight is placed within the piston means, and each end of the piston means is in fluid-communicating relation to a heating chamber. An expansible fluid is placed within the heating chamber such that when it is heated, the pressure resulting from the fluid's expansion will move the eccentric weight resulting in rotation of the axle.

An exhaust chamber is disposed in fluid-communicating relation to the heating chamber, and the fluid communication therebetween is valved so that the expanded fluid may be selectively vented into the exhaust chamber for condensation, collection, and return to the heating chamber for a subsequent cycle. Of course, thermal supply means must be operatively disposed relative to the heating chamber for the purpose of heating and expanding the expansible fluid.

For purposes of increased efficiency, it has been found desirable to construct the converter comprising a plurality of piston means. Each one of the piston means are angularly disposed relative to the adjacent piston so that their ends effectively describe a spiral. This construction, depending on the number of piston means utilized, would provide for the application of a motive force in a substantially continuous fashion. That is to say, less than 180° intervals.

While the exhaust chamber described above effectively provides for the dissipation of heat so that the cycle may be repeated, it has been determined that it may be advantageous to provide auxiliary cooling means. As will be described in greater detail hereinafter, one such means may take the form of a plurality of fins disposed on the exterior surface of the exhaust chamber means. In well known fashion these fins effectively increase the surface area of the exhaust chamber thereby allowing more rapid head loss. A second means for cooling the expanded fluid may comprise fan blades attached to the axle intermediate the piston means so as to force a continuous flow of ambient air across the device.

While thermal supply means for heating and expanding the fluid which moves the eccentric weights are obviously necessary to the present invention, the specific structure or form of such thermal supply means is not critical. For example, the thermal supply means may comprises reflector means directing the sun's rays to the heating chamber. Alternatively, the thermal supply means may comprise a source of industrial waste heat such as a smoke stack. Though perhaps more costly, the beam of a laser could be focused on the heating chamber.

It is thus seen that the present invention economically accomplishes a conversion of thermal energy into mechanical energy by employing a suitable expansible fluid such as a conventional low-boiling refrigerant and a design of a flywheel wherein the eccentric weight of the flywheel is continually moved by the expansion of the fluid to a position most advantageous to the continued rotation of the flywheel. The motive force to the flywheel is the falling of the mobile eccentric weight under the earth's gravitational field and imparting this motion to the flywheel and correspondingly to the axle means. The motive force may be further enhanced by selectively venting the expanded, pressurized fluid into an exhaust chamber through a jet valve.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

Similar reference characters refer to similar parts throughout the several views of the drawings.

DETAILED DESCRIPTION

Figure 1:
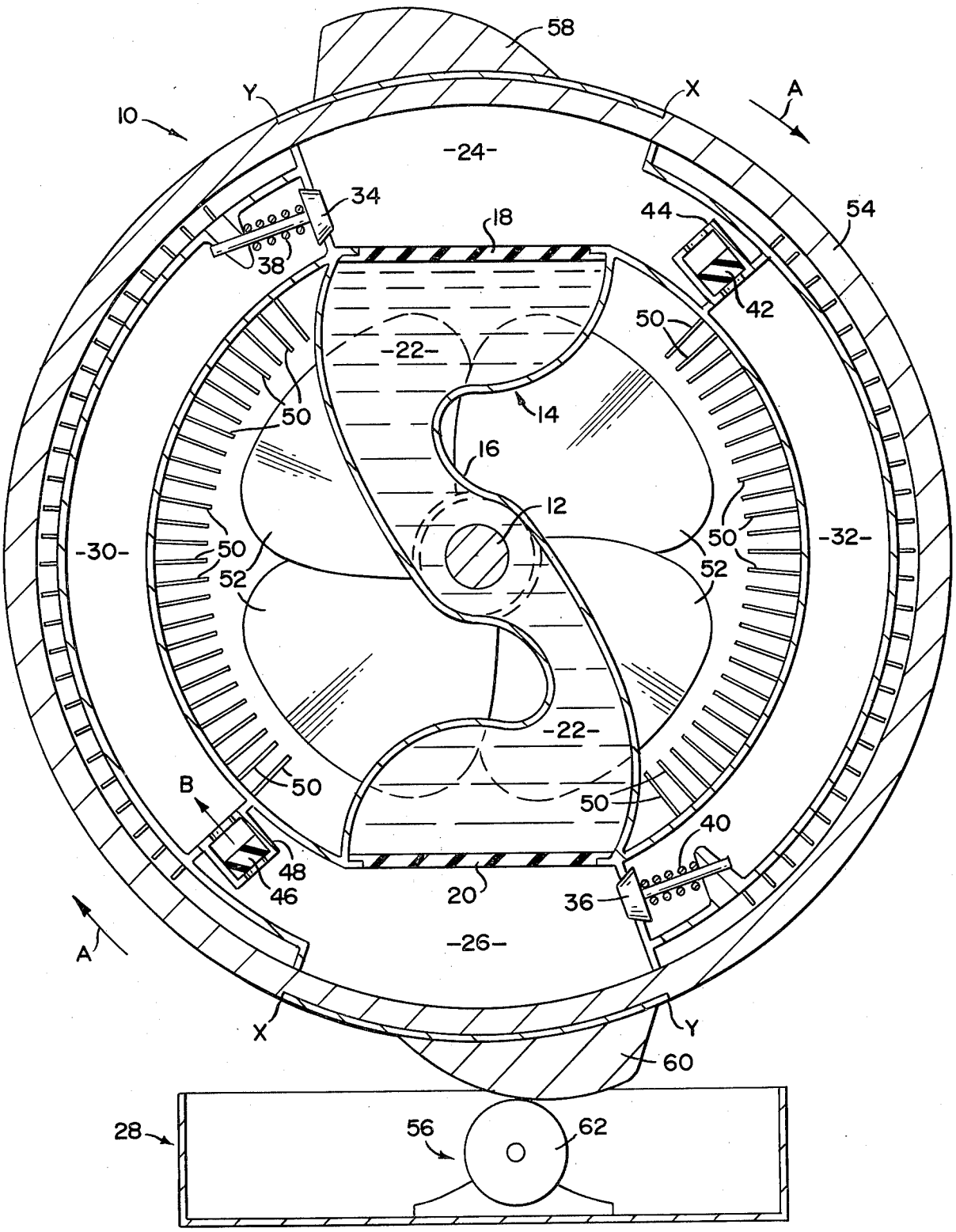
FIG. 1 is a sectional view of one embodiment of the present invention.

As best seen in the view of FIG. 1, the energy converter of the present invention comprises flywheel means generally indicated as 10 disposed in surrounding relation to axle means 12. Because flywheel 10 is fixedly attached to axle 12, rotation of flywheel 10 necessarily results in a corresponding rotation of axle 12, which rotation may be utilized as a direct source of mechanical energy. A piston means, or rotor means generally indicated as 14, extends across flywheel 10 in transverse relation to the axis of rotation of axle 12 such that the center of piston means 14 is substantially concentric with the axis of rotation of the converter. In the embodiment of FIG. 1, piston means 14 comprises a substantially S-shaped member 16 and a pair of flexible diaphragms 18 and 20. Diaphragms 18 and 20 comprise fluid-tight seals across the ends of member 16, and a heavy, non-compressible material 22, such as mercury, fills the space therebetween.

Heating chamber means comprising heating chambers 24 and 26 are integrally formed in flywheel 10 in fluid communicating relation to diaphragms 18 and 20, respectively. An expansible fluid, not shown, at least partially fills heating chambers 24 and 26. In the position shown in FIG. 1, thermal energy is supplied to heating chamber 26 and therefore to the fluid contained therein by a thermal supply means schematically indicated as 28. For example, thermal supply means 28 could comprise a reflector of the sun's rays. Applying thermal energy to heating chamber 26 will obviously cause the fluid contained therein to expand, deforming diaphragm 20 inwardly toward axle 12. This deformation of diaphragm 20 will shift, or move, non-compressible material 22 resulting in a corresponding outward deformation of diaphragm 18. S-shaped member 16 will become unbalanced, and flywheel means 10 will rotate in the direction of arrows A.

So that the expansible fluid may cool for reuse in a subsequent cycle, exhaust chamber means comprising exhaust chamber means comprising exhaust chambers 30 and 32 are integrally formed on flywheel 10 in fluid communicating relation to heating chambers 24 and 26. Corresponding first valves 34 and 36 are disposed in fluid regulating position on the exhaust sides of heating chambers 24 and 26, respectively. First valves 34 and 36 are maintained in a closed position by biasing means 38 and 40. The force exerted by biasing means 38 and 40 is such that they will maintain first valves 34 and 36 in their closed position until a predetermined pressure is reached within heating chambers 24 and 26. Again, with specific reference to the position shown in FIG. 1, when the predetermined pressure is reached in heating chamber 26, rotary motion in the direction of arrows A will already have begun. At this time, the force of biasing means 40 will be overcome, opening first valve 36. Fluid will instantaneously exhaust past first valve 36 from heating chamber 26 into exhaust chamber 32. The energy derived from this virtually instantaneous exhaust of fluid will necessarily tend to enhance the velocity of the rotary motion indicated arrows A.

As the fluid rushes into exhaust chamber 32 it will necessarily cool as it expands. Then, gravitational forces will move second valve 42 within its housing 44, thereby allowing the cooled, condensed fluid to pass into heating chamber 44. It should be noted that the expansion of fluid within heating chamber 26 would be confined within that chamber 26 by moving corresponding second valve 46 within its housing 48 as indicated by arrow B.

Having thus described the basic construction and operation of the embodiment of FIG. 1, reference should still be had to that drawing wherein the auxiliary features illustrated therein will now be described. As shown therein, a plurality of fins 50 may be provided along the exterior of exhaust chambers 30 and 32 for the purpose of increasing their effective surface area. Fins 50 necessarily enhance the effectiveness of exhaust chambers 30 and 32 in condensing fluid exhausted thereinto. Further enhancement of cooling, and therefor, increased heat dissipation, may be obtained by the provision of fan blades 52 attached to axle 12. As axle 12 rotates fan blades 52 will draw ambient air across fins 50 formed on the surface of exhaust chambers 30 and 32. While the features just described provide for increased efficiency in heat dissipation, it may also be advisable to provide a source of heat retention so that the expansible fluid in heating chambers 24 and 26 will rapidly expand as described above.

As shown in FIG. 1, heat retention is provided for in the form of heat ring 54 integrally formed around the exterior of flywheel 10. Of course, heat ring 54 must be thoroughly insulated along its entire length except for the arc between points X and Y where thermal energy must freely pass from thermal supply means 28 into heating chambers 24 and 26.

Finally, it has been determined that the thrusting action derived as from exhausting fluid from heating chamber 26 past first valve 36 into exhaust chamber 32 may be further enhanced by the addition of friction means generally indicated as 56. Friction means 56 comprises friction pads 58 and 60 integrally formed on the flywheel 10 in corresponding relation to heating chambers 24 and 26, respectively. As shown in FIG. 1, friction pad 60 will engage rotatable friction wheel 62 thereby providing an object, in addition to first valve 36 and its corresponding biasing means 40, against which the pressurized fluid in heating chamber 26 may "push." Of course, the engagement between friction pad 60 and friction wheel 62 must not be so great as to deleteriously affect the efficiency of the converter.

Alternately, pads 58 and 60 may be formed from a ferrous material and wheel 62 may include electromagnetic means. "Pulsing" the electromagnetic means of wheel 62 would, in effect, "pull" pad 60 in the direction of rotation indicated by arrow A and then "push" pad 60 away from wheel 62, further enhancing the angular momentum of flywheel 10. It is further intended that the electrical energy necessary to operate such an electromagnetic means could be generated by the converter itself.

Figure 2:
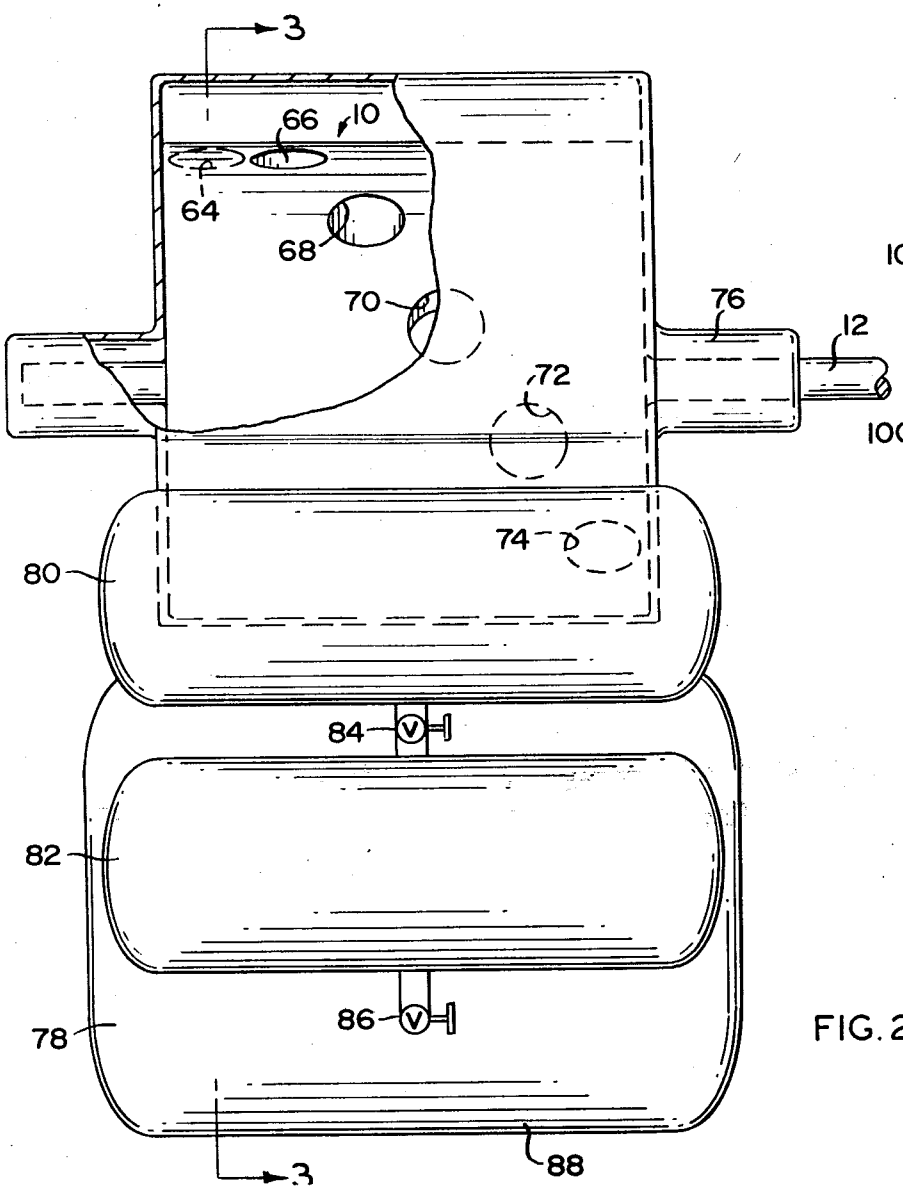
FIG. 2 is a side elevational view of a second embodiment of the invention with a portion of the housing cut away to show interior details.

FIG. 2 presents an elevational side view of the converter of the present invention with the rotating axle 12 oriented horizontally. The cutaway section of FIG. 2 exposes the essential features of flywheel 10 and the spiral arrangement of the piston means of this embodiment comprising piston chambers 64, 66, 68, 70, 72 and 74. Axle 12 is retained in bearing and vaporshield housing 76. Also depicted in FIG. 2 are schematic representations of heating chamber means 78, exhaust chamber means 80, condensate collector means 82, first valve cock 84 disposed in fluid communicating relation between exhaust chamber means 80 and condensate collector means 82, and second valve cock 86 disposed in fluid communicating relation between condensate collector means 82 and heating chamber means 78. First valve cock 84 and second valve cock 86 comprise elements of drain and pressure equalization piping more clearly seen in FIG. 3. Finally, it should be noted that flywheel 10 is shown as comprising a cylindrical mass containing the spirally-arranged piston chambers 64–74, inclusive.

Figure 3:
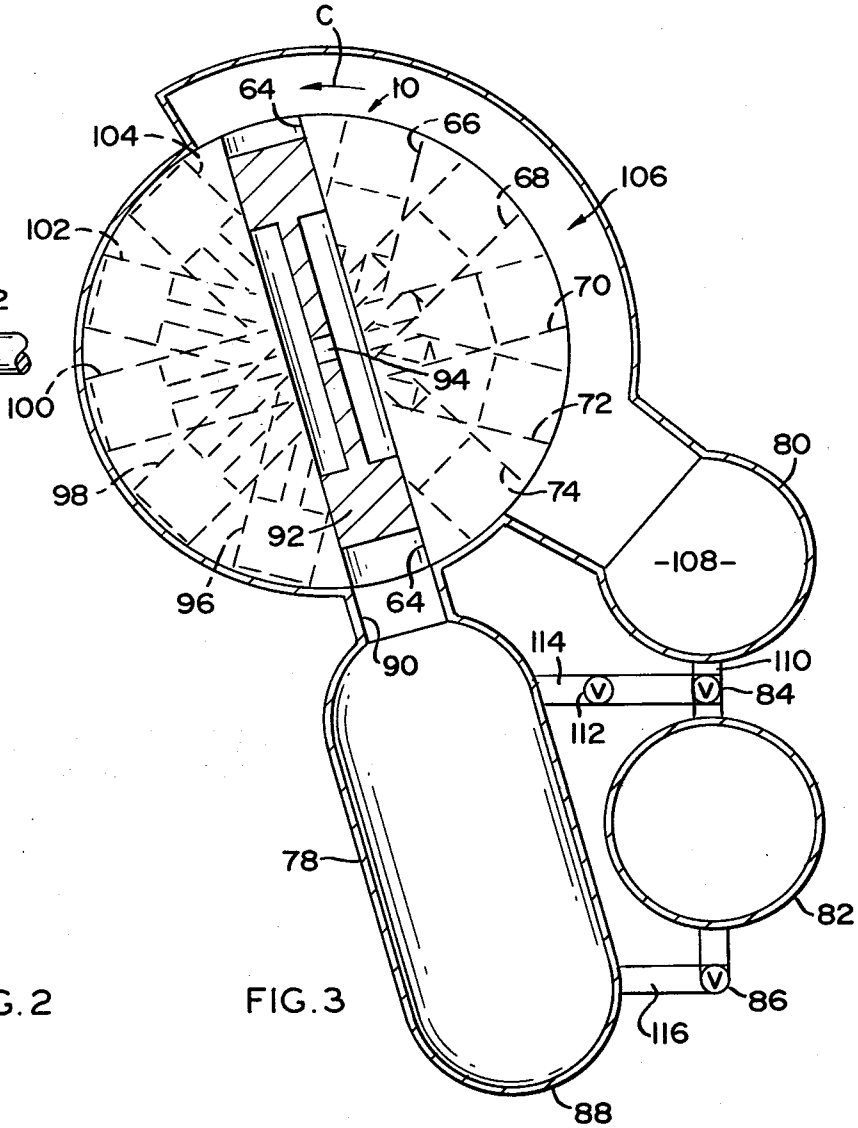
FIG. 3 is a sectional view taken along line 3—3 of FIG. 2.

Now, the specific construction and operation of this embodiment will be given with regard to the sectional view of FIG. 3. A suitable source of heat energy (not shown) is placed adjacent end 88 of heating chamber 78. This causes the fluid (not shown) within heating chamber 78 to evaporate, thereby providing sufficient vapor-pressure through opening 90 to raise piston rod 92 within piston chamber 64 so that the mass of piston rod 92 is eccentrically offset above the axis of rotation 94. This offset mass moves under the force of gravity imparting its motion to the rotational movement of flywheel 10, in addition to that being supplied by the eccentrically located piston rods 96, 98, 100, 102, and 104, each of which is similarly placed within its corresponding piston chamber. As flywheel 10 rotates in the direction of arrow C, piston chamber 66 and its corresponding piston rod 96 will move into position above opening 90 and piston rod 96 will be raised so that its mass is eccentrically offset above the axis of rotation 94 to continue to provide a rotational motive force to flywheel 10 and therefore to axle 12. In a similar manner, all piston chambers will sequentially move into position, and their piston rods will be raised by the fluid vapor pressure to provide continuous motive force to flywheel 10. Since, as shown in FIG. 2, axle 12 is integrally formed on flywheel 10, rotation of flywheel 10 also rotates axle 12 to provide useful mechanical energy.

After the piston chambers pass the opening 90 and the piston rods have been raised, the piston chambers are exposed to exhaust chamber 80. Specifically, and still with reference to FIG. 3, as flywheel 10 rotates in the direction of arrow C, piston chamber 64 will be exposed to exhaust plenum 106 defining a portion of exhaust chamber means 80. From exhaust plenum 106 the pressurized vapor will condense in vapor condenser 108 of exhaust chamber means 80. The condensed fluid drains through conduit 110 and first valve cock 84 into condensate collector means 82. When condensate collector means 82 is filled, first valve cock 84 closes, third valve cock 112 opens, and the pressure between heating chamber means 78 and condensate collector means 82 is equalized through bypass conduit 114. Second valve cock 86 is then opened to drain condensate collector means 82 through resupply conduit 116 into heating chamber means 78. When fluid levels in the heating chamber means 78 and condensate collector means 82 are equalized, second valve cock 86, third valve cock 112 are reclosed, first valve cock 84 is reopened, and operation continues. In should be noted that intermittent pressure fluctuations and incomplete piston movement caused by this recirculation of the condensed fluid will be masked by the momentum of flywheel 10. In fact, even temporary interruption of the low-energy heat source would be absorbed by the flywheel's momentum.

Figure 4:
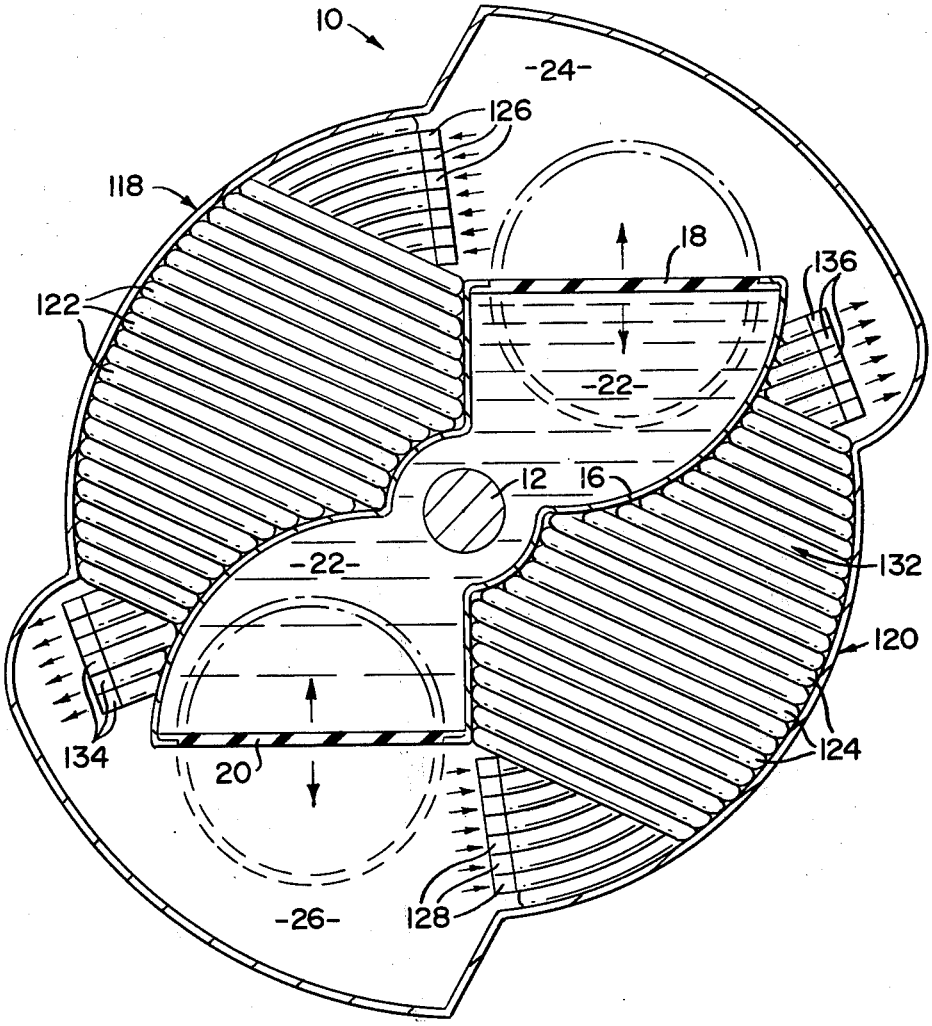
FIG. 4 is a sectional view similar to that of FIG. 1 showing another embodiment of the exhaust chamber means of the present invention.

FIG. 4 presents yet another embodiment of the energy converter of the present invention, similar to that of FIG. 1, wherein the exhaust chambers comprise two sets, generally indicated as 118 and 120, of exhaust coils. Much like the exhaust chambers 30 and 32 of FIG. 1, sets 118 and 120 receive pressurized fluid from heating chambers 24 and 26, respectively. As the fluid passes through sets 118 and 120 it expands, cools, condenses and finally collects in the opposite heating chamber for a subsequent cycle.

Now with specific regard to the converter in the position shown in FIG. 4, sets 118 and 120 each comprise a plurality of individual coils 112 and 124, respectively. As fluid in heating chamber 26 is heated its vapor pressure increases as described hereinabove, and flywheel 10 begins to rotate under the force of earth's gravity.

As the vapor pressure within heating chamber 26 increases, each of the conduits 124 successively open their corresponding first valves 128 to admit the pressurized fluid. Valves 128 open individually in response to predetermined pressure increases. That is, the outermost valve 128 is first to open, and the innermost valve 128 opens last. Opening valves 128 necessarily allows the pressurized fluid to enter corresponding exhaust coils 124. The exterior surface 132 of coils 124 may be insulated and wetted to enhance the cooling and condensation of the fluid as it passes therethrough. Finally, the condensed fluid exits coils 124 through second one-way valves 136 into heating chamber 24 for a subsequent cycle. Of course, the operation of the converter's cycle from heating chamber 24 is substantially identical to that just described, but the fluid passes through first valves 126, exhaust coils 122, and second one-way valves 134 into heating chamber 26.

The construction just described above represents simply a second embodiment of the invention, and it is understood that the same is not limited thereto but is susceptible to many changes and modifications. For example, it is submitted that the mobile eccentric weight could be a liquid as described with regard to FIG. 1 and that the piston chambers described with regard to FIGS. 2 and 3 need not be right circular cylinders.

Figure 5:
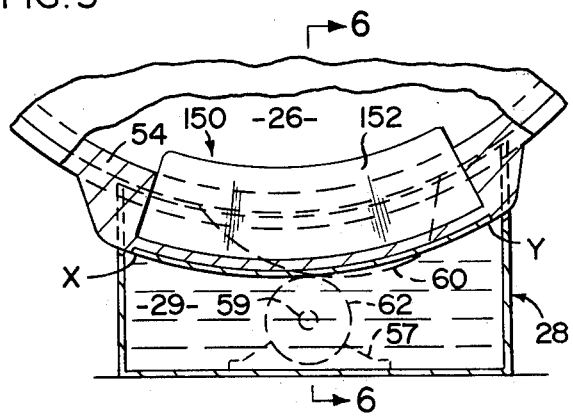
FIG. 5 is a sectional, partial cutaway view of one embodiment of the present invention.
Figure 6:
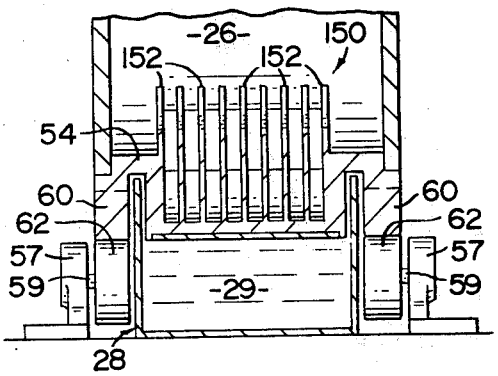
FIG. 6 is a sectional view of the embodiment of FIG. 5 taken along line 6—6 of FIG. 5.

Turning to FIGS. 5 and 6, the structure disclosed therein represents yet another embodiment of the present invention which is adaptable preferably to the embodiment of FIG. 1, but also to the other structural embodiments of the present invention set forth in the remaining Figs. More specifically, FIGS. 5 and 6 are directed to a heat collection means generally indicated as 150. This heat collection means comprises a plurality of heat conducting fins mounted on the interior surface of heat ring 54 wherein each of the individual fins 152 extend from heat ring 154 into each of the chambers 24 and 26. It will be noted that in FIGS. 5 and 6 only chamber 26 is indicated for purposes of clarity. However, it should be specifically noted at this point that the heat collection means 150 is mounted in cooperative relation with both the chambers 24 and 26. The disposition and configuration of the heat collecting fins 152 is such as to have the base of each of the fins extend down into thermal supply means 28. The upper extremity of each of the fins 52 are disposed to extend into the chambers 26 (or 24) so as to accomplish a more efficient heat transfer. As set forth with relation to the description of the embodiment of FIG. 1, the thermal supply means 28 may be in the form of a container having super heated water 29 passing therethrough. The relative dispositions of the thermal supply means 28 and the heating fluid 29 relative to the various fin elements 52 is such as to transfer heat from the fluid 29 directly into chamber 22 not only through the non-insulated portion "XY", but directly through the heat conducting fin elements 152.

The friction pads 60 are disposed to engage the rotatable friction wheels 62 generally, in the same manner as set forth with regard to the description of FIG. 1. These rotatable friction wheels are mounted on shafts 59 which are supported by supporting frame portion 57. With regard to this embodiment it should be noted that, preferably, the heat conducting fins 152 are disposed relative to the heat ring 54 so as to be submerged below the normal level of fluid 29 maintained in the thermal supply means 28 as best shown in FIG. 6. This specific structural configuration will accomplish maximum and most efficient heat transfer of the heat from the heating fluid 29 into the chamber 26 (or 24) as desired.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described:

What is claimed is:

1. An energy converter of the type primarily used to convert thermal energy into mechanical energy, said energy converter comprising: support means; axle means rotatable disposed on said support means; rotor means mounted on said axle means in substantially transverse relation to the axis of rotation of said axle means; flywheel means disposed in substantially concentric relation to said axis of rotation for rotation with said rotor means; heating chamber means disposed in fluid-communicating relation to one end of said rotor means; exhaust chamber means disposed in fluid-communicating relation to said heating chamber means; an expansible fluid placed in said heating chamber means; valve means interconnecting said heating and exhaust chamber means whereby the flow of said fluid therebetween may be regulated; and thermal supply means operatively disposed relative to said heating chamber means enabling heating of at least a portion of said rotor means causing a displacement of mass within said rotor means thereby rotating said axle.

2. An energy converter as in claim 1 wherein said rotor means comprises a substantially S-shaped hollow member the mid-point of which is substantially coincident with said axis of rotation and a liquid filling at least most of said hollow member; said rotor means further comprising a pair of flexible diaphragms, one of each of said pair being disposed within each end of said hollow member so as to restrain said liquid therebetwen, whereby pressure at one end of said hollow member will cause said liquid to move toward the other end of said member thereby causing rotation of said axle.

3. An energy converter as in claim 2 wherein said heating chamber means is integrally formed on a portion of said flywheel means.

4. An energy converter as in claim 2 wherein said exhaust chamber means is integrally formed on a portion of said flywheel means.

5. An energy converter as in claim 2 wherein said heating chamber means comprises a pair of heating chambers, one of said heating chambers being integrally formed on said flywheel means in fluid communicating relation to a corresponding one of said diaphragms.

6. An energy converter as in claim 5 wherein said exhaust chamber means comprises a pair of enhaust chambers, one of said exhaust chamber being integrally formed on said flywheel means in fluid communicating relation between each of said heating chambers.

7. An energy converter as in claim 6 wherein said valve means comprises a first valve disposed in fluid communicating relation between each of said heating and exhaust chamber, said first valve being positioned so as to allow a one way flow of said fluid therethrough in a direction substantially opposite to the direction of rotation of said axle; said valve means further comprising a second valve disposed in fluid communicating relation between each of said heating and exhaust chambers, said second valve being positioned so as to allow a one way flow of said fluid from one of said exhaust chambers into the corresponding one of said heating chamber, whereby said one heating chamber is recharged.

8. An energy converter as in claim 7 wherein said first valve further comprises pressure responsive actuation means, whereby said first valve will open in response to the pressure of said fluid within said heating chamber reaching a predetermined value.

9. An energy converter as in claim 8 wherein said exhaust chambers further comprise a plurality of fins formed on the exterior surface thereof, whereby said fluid exhausted thereinto will cool more rapidly.

10. An energy converter as in claim 8 further comprising fan means operatively disposed on said axle means, whereby ambient air will be drawn across said exhaust chambers.

11. An energy converter as in claim 8 further comprising friction wheel means disposed in engaging relation to a portion of said flywheel means when one of said heating chambers is being heated by said thermal supply means.

12. An energy converter as in claim 8 further comprising heat ring means formed on said converter in surrounding relation to said heating and exhaust chambers, said heat ring means comprising a heat ring extending in substantially concentric relationship to said one heating and exhaust chambers, the radius of the arc described by said heat ring being relatively greater than the radius described by said heating and exhaust chambers, said heat ring means further comprising insultation means placed in surrounding relation thereto in the vicinity of said exhaust chambers.

13. An energy converter as in claim 1 wherein said rotor means comprises a hollow member the mid-point of which is substantially coincident with said axis of rotation and a rod disposed within said hollow member and reciprocally movable therein, each end of said rod engaging the interior of said hollow member in substantially fluid-tight relation thereto, whereby pressure at one end of said hollow member will cause said rod to move toward the other end of said member thereby causing rotation of said axle.

14. An energy converter as in claim 13 wherein said heating chamber means, said exhaust chamber means and said valve means are disposed in substantially surrounding relation to said flywheel means to define a closed system for the circulation of said expansible fluid.

15. An energy converter as in claim 14 wherein said heating chamber means includes a pressure aperture formed therein in fluid communicating relation to one end of said hollow member, whereby said fluid may expand into said one end of said hollow member disposed in corresponding relation thereto.

16. An energy converter as in claim 15 wherein said exhaust chamber means includes an exhaust plenum disposed in fluid communicating relation with said one end of said hollow member whereby said fluid pressurized therein may be exhausted, said exhaust chamber further comprising a vapor condenser communicating with said exhaust plenum for the condensation of exhausted fluid.

17. An energy converter as in claim 16 wherein said valve means comprises condensate collector means disposed in interconnecting relationship between said heating chamber means and said exhaust chamber means and a plurality of valve cock means, at least one of said valve cock means disposed in fluid regulating position between said exhaust chamber means and said condensate collector means and between said condensate collector means and said heating chamber means.

18. An energy converter as in claim 17 wherein said valve cock means comprise a first valve cock intermediate said exhaust chamber means and said condensate collector means and a second valve cock intermediate said condensate collector means and said heating chamber means.

19. An energy converter as in claim 18 wherein said valve means further comprises a bypass conduit disposed in fluid communicating relation between said condensate collector means and said heating chamber means and a third valve cock mounted in fluid regulating relation to the flow of said fluid through said bypass conduit.

20. An energy converter as in claim 1 comprising a plurality of said rotor means, the longitudinal dimension of each one of said plurality being angularly disposed relative to an adjacent one of said plurality, whereby the ends of said plurality describe a spiral.

21. An energy converter as in claim 1 further comprising heat collection means mounted within said heating chamber means in direct contact with said heating fluid disposed within said heating chamber means.

22. An energy converter as in claim 21 wherein said heat collection means comprises a plurality of heat collecting fin elements configured and disposed to extend into said heating chamber means, said plurality of fin elements further disposed in heat conduction relation to said thermal supply means, whereby heat is transferred from said thermal supply means into said heating chamber means through said heat collecting means.

23. An energy converter as in claim 22 wherein said thermal supply means comprises container means having heated fluid therein and disposed in direct engagement with the periphery of said flywheel means, said plurality of fin elements formed from a heat conductive material and mounted contiguous to a peripheral portion of said flywheel means, said fin elements movable into heat transfer relation relative to said heated fluid upon rotation of said flywheel means.

24. An energy converter as in claim 23 wherein said plurality of fin elements are disposed in spaced, substantially parallel relation to one another and extend from a point in direct heat transfer relation relative to said heated fluid into the space defined by said heating chamber means.

* * * * *

UNITED STATES PATENT AND TRADEMARK OFFICE

CERTIFICATE OF CORRECTION

PATENT NO. : 4,019,325

DATED : April 26, 1977

INVENTOR(S) : Paschal H. Murphy, Jr.

It is certified that error appears in the above-identified patent and that said Letters Patent are hereby corrected as shown below:

Column 4, line 23, eliminate "exhaust chamber means comprising"

Column 6, line 59, "112" should read - 122 --.

Column 8, line 19, "rotatable" should be -- rotatably --.

Signed and Sealed this

*thirtieth* Day of *August 1977*

[SEAL]

*Attest:*

RUTH C. MASON
*Attesting Officer*

C. MARSHALL DANN
*Commissioner of Patents and Trademarks*